United States Patent [19]

Wood

[11] 4,266,587

[45] May 12, 1981

[54] MANUAL TOOL

[76] Inventor: Ray E. Wood, 2303 E. 5th St., Anderson, Ind. 46012

[21] Appl. No.: 62,699

[22] Filed: Aug. 1, 1979

Related U.S. Application Data

[63] Continuation of Ser. No. 918,781, Jun. 26, 1978, abandoned, which is a continuation of Ser. No. 783,947, Apr. 1, 1977, abandoned.

[51] Int. Cl.[3] ..... B25B 15/00

[52] U.S. Cl. ..... 81/1 R; 76/101 D; 76/114; 76/DIG. 4; 81/180 R; 81/418

[58] Field of Search ..... 145/50 R, 50 A; 81/71, 81/180 R, 418; 76/101 D, 114, DIG. 4

[56] References Cited

U.S. PATENT DOCUMENTS

| | | | |
|---|---|---|---|
| 1,369,378 | 2/1921 | Berberian | 240/6.46 |
| 1,614,303 | 1/1927 | Humphries | 76/DIG. 4 |
| 2,272,902 | 2/1942 | Bible | 240/6.46 |
| 2,773,974 | 12/1956 | Markett | 240/6.46 |
| 3,919,541 | 11/1975 | Chao | 240/6.46 |

OTHER PUBLICATIONS

"Chrome Surfaces Electronically Deposited"; *The Blast Furnace & Steel Plant;* C. G. Fink, Ph.D.; Jun. 1925, pp. 234–235.

*Primary Examiner*—Stephen G. Kunin
*Assistant Examiner*—J. T. Zatarga
*Attorney, Agent, or Firm*—Meyer, Tilberry & Body

[57] ABSTRACT

An improvement in a manual tool having an end, a work engaging tip at the end, a handle spaced from the end and an elongated terminal portion extending from the work engaging tip wherein the elongated terminal portion has a peripheral surface also extending from the work engaging tip. The improvement comprises the application of a layer of light reflective material on the peripheral surface and adjacent the tip whereby light will be reflected into the actual work area which may in some instances be dark.

4 Claims, 6 Drawing Figures

MANUAL TOOL

This is a continuation of application Ser. No. 918,781 filed June 26, 1978, now abandoned, which is a continuation of application Ser. No. 783,947 filed Apr. 1, 1977, now abandoned.

The present invention relates to the art of manual tools of the type used in recessed areas and including an elongated portion terminating in a work engaging tip, such as a screwdriver, needle-nosed pliers and the like and more particularly to an improved manual tool of this type including a means for providing light in the work area.

PRIOR ART

Prior manual tools of the type to which the present invention is directed include a light source for lighting the work area. This concept is shown in prior U.S. Pat. Nos. 2,288,093 and 2,674,685. Such structures require a light source, battery and related equipment to direct light into the work area being serviced by a tool. In French Pat. No. 553,441, a light source is directed onto the tool which is then directed into the work area. This requires modification of the tool. This prior art relating to the concept of illuminating the work area is the art to which the present invention is directed and is incorporated by reference herein as background information.

BACKGROUND

As shown in the prior art patents which are discussed above, there is a recognized difficulty in using a screwdriver or other pointed manual tool in a dark, recessed area. Often a screw or bolt in such an area is manipulated by touch, since it can not be seen because of shadows or other light blocking conditions. In some instances, a light is directed into the work area; however, this requires two hands and unduly complicates the dexterity required for the use of the tool. To overcome these disadvantages, some tools, such as screwdrivers have been provided with light sources. This is shown in the prior art mentioned above and requires a battery and special construction for the tool to provide the required light in the work area.

These disadvantages have been overcome by the present invention which relates to an improved structure for illuminating the work area being serviced by an elongated tool such as a screwdriver, allen wrench, needle-nosed pliers and the like.

THE INVENTION

In accordance with the present invention, there is provided an improvement in a manual tool of the type having an elongated structure with an end, a work engaging tip at the end, a handle spaced from the end and an elongated terminal portion extending from the work engaging tip toward the handle. This improvement involves the application of a layer of light reflective material on the peripheral surface of the elongated terminal portion and adjacent the tip.

In accordance with a more limited aspect of the invention, the layer is spaced from the end of the tool itself approximately 1/16 to ¼ inch.

By using this structure, a standard screwdriver can be provided with a reflective layer at the end which allows reflection of light into the work area being serviced by the tool. Consequently, a standard tool is adapted for use in dark areas in a manner which will reflect light into the dark areas and assist in manipulation of the tool and performance of its work.

In accordance with the primary object of the present invention is the provision of an improvement in a manual tool of the type having an elongated portion terminating in a work engaging tip, which improvement allows reflection of light into the work area being serviced by the tool tip.

Still a further object of the present invention is the provision of an improvement as defined above, which improvement can be applied at little cost to a standard tool.

These and other objects and advantages will become apparent from the following description taken together with the accompanying drawings.

PREFERRED EMBODIMENT

Figure 1:
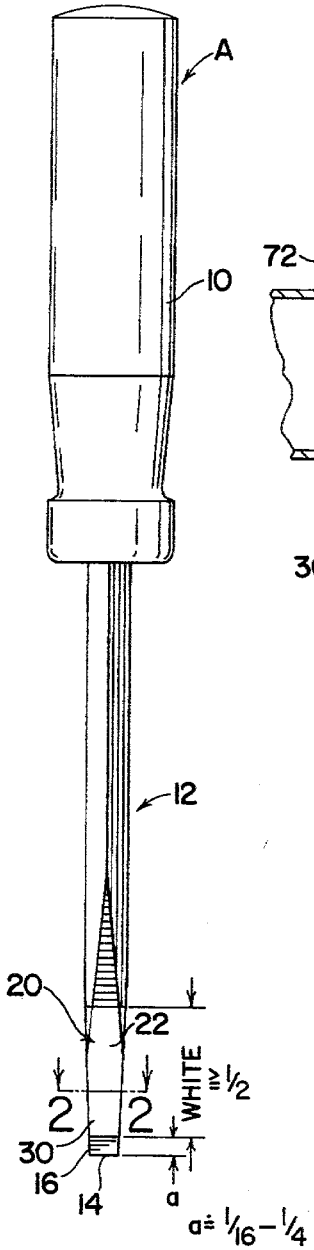
FIG. 1 is a side elevational view of a screwdriver being improved in accordance with the present invention.
Figure 2:
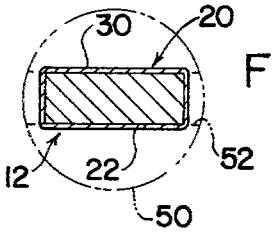
FIG. 2 is an enlarged cross-sectional view taken generally along line 2—2 of FIG. 1.

Referring now to the drawings, wherein the showings are for the purpose of illustrating the preferred embodiment of the invention only, and not for the purpose of limiting same, FIG. 1 shows a manual tool A in the form of a screwdriver having an upper handle 10, an elongated shaft 12, a lower end 14 and a work engaging tip 16. The present invention relates to a manual tool of the type shown which has a work engaging tip supported by an elongated shaft like portion extending from one end of the tool upwardly. Such tools are screwdrivers, allen wrenches, needle-nosed pliers and other manipulative tools often used in relatively dark work areas. As illustrated, screwdriver A includes an elongated portion 20 extending from tip 16 toward handle 10 and having an outer peripheral surface 22. As so far described, screwdriver A is no different than a standard screwdriver; however, in accordance with the preferred embodiment of the invention, a light reflecting layer 30 is provided on surface 22 from adjacent tip 16 upwardly. In accordance with the preferred embodiment of the invention, layer 30 is a coating, such as a coating of paint. The paint is predominately white so that it is quite reflective. Of course, other paints could be employed. In accordance with the present invention, the layer or coating 30 is merely applied to the surface 22 adjacent tip 16 by masking the tip 16 and dipping the tool, by brushing the coating onto the tool or by other appropriate methods. In this manner, a standard screwdriver can be converted into a screwdriver having means for directing light into the work area for ease of tool manipulation. In accordance with one aspect of the invention, coating 30 is spaced from end 14 a distance a which is preferably in the general range of 1/16-¼ inch. Coating 30 may extend upwardly on shaft 12 any distance; however, in practice it is intended that this coating will extend at least about ½ inch.

Figure 3:
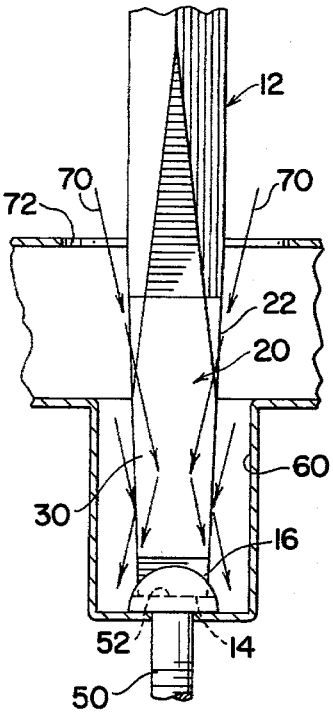
FIGS. 3 and 4 are enlarged schematic views illustrating the use of the improved screwdriver, as illustrated in FIG. 1.
Figure 4:
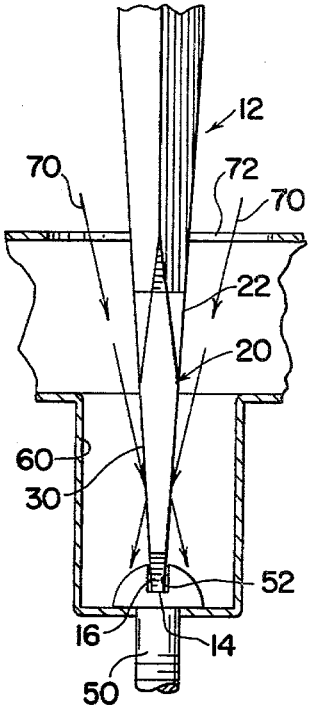

Referring now to FIGS. 3 and 4, the advantage of the present invention is clearly illustrated. A screw 50 provided with an upper tip engaging slot 52 is to be manipulated in a dark work area 60 wherein ambient light 70 is available adjacent opening 72 for access to the work area 60. By using the present invention, ambient light 70 is reflected from layer 30 into the work area 60 to illuminate the area and allow ease in manipulating tip 16 with respect to slot 52.

Figure 5:
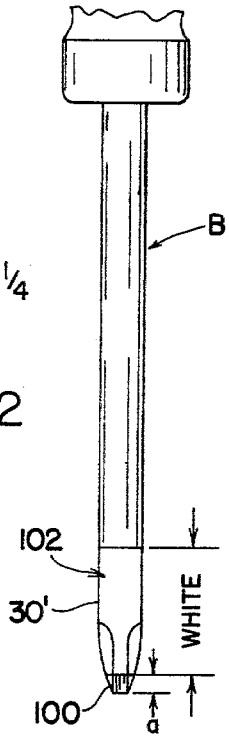
FIG. 5 is a partial side elevational view showing a Phillips head screwdriver provided with the present invention; and, FIG. 6 is a side elevational view showing a standard needle-nosed pliers provided with the improvement of the present invention.
Figure 6:
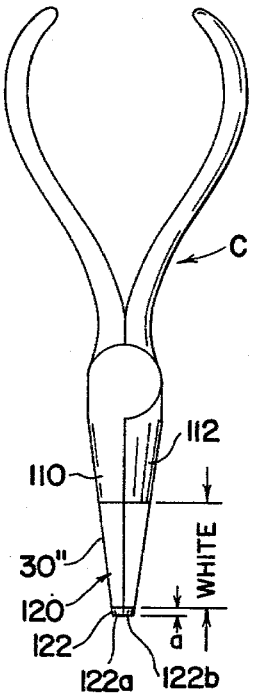

Referring now to FIG. 5, a Phillips head screwdriver is provided wherein tip 100 is supported on the end of elongated portion 102. A layer or coating 30' is used in the same manner as layer or coating 30 in FIG. 1. This view is submitted to illustrate the use of the invention on modified manually manipulated tools. Still a further concept is shown in FIG. 6 wherein pliers C having ends 110, 112 which combine to define peripheral elongated portion 120 are used to define a work engaging tip 122. This tip comprises movable halves **122*a*, 122*b*. In this embodiment, elongated portion 20 has an outer surface which is separated during manipulation of the tool. In practice, coating 30'' is provided upon the outer periphery of elongated portion 120 but not between the manipulative ends 110, 112**.

Having thus defined the invention, it is claimed:

1. An improvement in a manual tool having an end, a work engaging tip at said end, a handle spaced from said end and an elongated terminal portion having a peripheral surface extending from said work engaging tip, said improvement comprising: a layer of predominately white, light-reflective material on said peripheral surface and adjacent to, but spaced a selective distance from, said tip whereby ambient light from a source spaced from said tool is reflected from said layer.

2. The improvement as defined in claim 1 wherein said selective distance is in the general range of 1/16 to ¼ inch.

3. The improvement as defined in claim 1 wherein said layer extends completely around said peripheral surface.

4. The improvement as defined in claim 1 wherein said layer has an axial length at least about ½ inch.

* * * * *